United States Patent [19]

Aoyama et al.

[11] 4,448,182

[45] May 15, 1984

[54] IGNITION SYSTEM FOR INTERNAL COMBUSTION ENGINES

[75] Inventors: Jun Aoyama; Noboru Nakayama, both of Okazaki, Japan

[73] Assignee: Nippondenso Co., Ltd., Kariya, Japan

[21] Appl. No.: 185,920

[22] Filed: Sep. 10, 1980

[30] Foreign Application Priority Data

Sep. 10, 1979 [JP] Japan ..... 54-115871

[51] Int. Cl.[3] ..... F02P 3/04

[52] U.S. Cl. ..... 123/605; 123/621; 123/648; 123/652; 123/149 D

[58] Field of Search ..... 123/149 D, 648, 650, 123/652, 599, 605, 618, 621; 315/209 SE, 209 T

[56] References Cited

U.S. PATENT DOCUMENTS

| | | | |
|---|---|---|---|
| 3,331,362 | 7/1967 | Mitchell | 123/621 |
| 3,431,901 | 3/1969 | Rogers | 123/621 |
| 3,439,663 | 4/1969 | Lombardini et al. | 123/149 D |
| 3,531,738 | 9/1970 | Thakore | 315/209 T |
| 3,824,976 | 7/1974 | Katsumata et al. | 123/149 D |
| 3,854,466 | 12/1974 | Steinberg et al. | 123/618 |
| 3,893,438 | 7/1975 | Diener | 123/605 |
| 4,120,277 | 10/1978 | Ehlen | 123/149 D |
| 4,349,008 | 9/1982 | Wainright | 123/621 |

FOREIGN PATENT DOCUMENTS

| | | | |
|---|---|---|---|
| 249822 | 2/1963 | Australia | 123/621 |
| 889796 | 2/1962 | United Kingdom | 123/621 |
| 2021687 | 12/1979 | United Kingdom | 123/599 |

*Primary Examiner*—Parshotam S. Lall
*Assistant Examiner*—W. R. Wolfe
*Attorney, Agent, or Firm*—Cushman, Darby & Cushman

[57] ABSTRACT

An ignition coil includes a primary winding, an auxiliary primary winding and an ignition high voltage generating secondary winding which are wound on the same core. The primary current from the generating coil of a magneto flows to the base of a transistor through the primary winding of the ignition coil. The primary current flowing through the primary winding induces a voltage across the auxiliary primary winding and the induced voltage is applied between the base and emitter of the transistor. At the time of ignition, the primary current flowing to the base of the transistor is shunted by a semiconductor switching element so that the transistor is turned off and the current flowing through the auxiliary primary winding is interrupted, thus generating a high voltage across the secondary winding of the ignition coil.

5 Claims, 6 Drawing Figures

IGNITION SYSTEM FOR INTERNAL COMBUSTION ENGINES

BACKGROUND OF THE INVENTION

The present invention relates to ignition systems for internal combustion engines and more particularly a semiconductor ignition system employing a magneto.

Known current interruption type transistorized ignition systems employing a magneto have a circuit construction in which a transistor and an ignition coil are connected in parallel with the generating coil of a magneto. The output of the generating coil is first short-circuited by the transistor and then the transistor is turned off at the time of ignition of the engine, thus utilizing the resulting transient voltage in the generating coil to cause a rapid current flow to the primary winding of the ignition coil and utilizing the resulting magnetic flux change to generate a high voltage in the secondary winding of the ignition coil.

However, in known ignition systems of the above type the base current is shunted to turn off the transistor. The base current must be reduced as far as possible since it represents a current which does not flow to the ignition coil or one which is ineffective in the generation of a high voltage. As a result, it has been necessary to use Darlington-connected power transistors having an amplification factor of about 100 times. The Darlington-connected power transistors are disadvantageous in that they are expensive and their collector-emitter saturation voltage is high. Another disadvantage is that, due to a high collector-emitter voltage generated upon turning the transistors on, in order to prevent this high voltage from causing current flow to the ignition coil before turning off of the transistors, a voltage-regulator element such as a diode must be connected between the transistors and the ignition coil, thus requiring a complicated and expensive circuit construction.

SUMMARY OF THE INVENTION

It is an object of the present invention to provide an ignition system for internal combustion engines in which an output of a generating coil is utilized effectively to generate a high ignition voltage of a greater magnitude.

It is another object of the present invention to provide an ignition system for internal combustion engines that's circuit power consumption is small and which is inexpensive to manufacture.

It is still another object of the present invention to provide an ignition system for internal combustion engines which is simple in circuit design.

In accomplishing these objects, a preferred embodiment of the system in accordance with the present invention comprises an ignition coil including a primary winding, an auxiliary winding and a secondary winding which are wound on the same core, a single transistor having its base connected to one end of the primary winding the other end of which is connected to one end of a generating coil. The transistor collector is connected to one end of the auxiliary winding and its emitter is connected to the other end of the auxiliary winding. A semiconductor switching element, such as a thyristor, is connected between the base and emitter of the transistor. The transistor emitter is also connected to the other end of the generating coil, whereby the output of the generating coil is applied to the primary winding of the ignition coil through the base-emitter path of the transistor, so that the current produced in the auxiliary winding tends to cancel the magnetic flux change in the ignition coil core caused by the current in the primary winding, and is supplied through the collector-emitter path of the transistor. The base current of the transistor is shunted by the semiconductor switching element at the time of ignition of the engine, thus turning off the transistor and rapidly interrupting the collector current flowing to the auxiliary winding, thereby generating a high ignition voltage in the secondary winding by the resulting magnetic flux change in the core of the ignition coil.

DESCRIPTION OF THE PREFERRED EMBODIMENTS

The present invention will now be described with reference to the illustrated embodiments.

Figure 1:
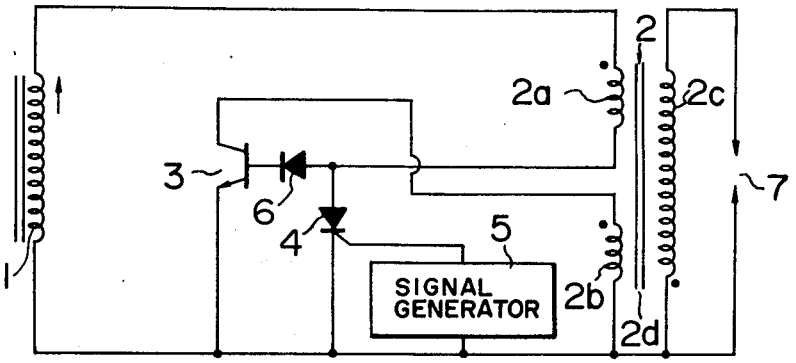
FIGS. 1, 2, 3, 4, 5 and 6 are circuit diagrams showing respectively first second, third, fourth, fifth and sixth embodiments of the ignition system according to the invention.

Referring to FIG. 1 showing a circuit diagram of a first embodiment of an ignition system according to the invention. The ignition system comprises a generating coil 1 incorporated in a magneto, an ignition coil 2, a single power transistor 3, which is not of Darlington type, a thyristor 4, a signal generator 5, a diode 6 and a spark plug 7. The ignition coil 2 includes a primary winding 2*a*, an auxiliary winding 2*b* and a secondary winding 2*c* which are wound on the same core 2*d*, with the ratio of turns in the windings 2*b* and 2*c* to that of the winding 2*a* being on the order of 1:1 to 3:1. The primary winding 2*a* has its one end connected to one end of the generating coil 1 and its other end connected to the base of the transistor 3 through the diode 6. The auxiliary winding 2*b* has one end connected to the collector of the transistor 3 and its other end connected to the emitter of the transistor 3. The primary winding 2*a* and the auxiliary winding 2*b* are wound with the polarities shown.

With the construction described above, the operation of the first embodiment is as follows. When a voltage is generated in the generating coil 1 in the direction of the arrow, the output is applied to the primary winding 2*a* of the ignition coil 2, through the diode 6 and the base-emitter path of the transistor 3 causing a current flow therein. This current produces a magnetic flux in the core 2*d* of the ignition coil 2 and the generation of the magnetic flux produces an electromotive force in the auxiliary winding 2*b*.

Since this electromotive force is a voltage which is positive with respect to the collector of the transistor 3, conduction is produced through the collector and emitter of the transistor 3 and the resulting short-circuit current flows through the auxiliary winding 2*b*. If $i_l$ represents the current in the primary winding 2*a* and Na and Nb respectively represent the number of turns in the primary winding 2*a* and the auxiliary winding 2*b*, respectively, then the short-circuit current $i_s$ is given by $i_s \approx (Na/Nb) \cdot i_l$. With the auxiliary winding 2*b* short-circuited, if the loss of the core 2*d* is neglected, the magnetic flux in the core 2*d* is considered zero, since the magnetic flux caused by the current flowing in the primary winding 2*a* is cancelled by the magnetic flux caused by the short-circuit current flowing in the auxiliary winding 2*b*. Thus, at this time no high voltage is generated in the secondary winding 2*c* of the ignition coil 2.

In this condition, if a signal voltage is applied to the gate of the thyristor 4 from the signal generator 5 in synchronism with the ignition timing of the engine, the thyristor 4 is turned on so that the base current of the transistor 3 is shunted by the thyristor 4 and the transistor 3 is turned off. When this occurs, the collector current of the transistor 3 is rapidly interrupted and the auxiliary winding 2*b* is changed from the short-circuited condition to the open condition. Thus, since the current is flowing continuously in the primary winding 2*a* through the thyristor 4 at this time, a magnetic flux change is rapidly caused in the core 2*d* due to the interruption of the short-circuit current flow in the auxiliary winding 2*b*. This magnetic flux change produces a high voltage in the secondary winding 2*c* of the ignition coil 2 and a spark is produced at the spark plug 7.

This circuit construction permits effective utilization of the entire output of the generating coil 1 for high voltage generating purposes, thus ensuring the generation of a high secondary voltage of a greater magnitude. Further, since the single transistor 3 is used in place of Darlington-connected transistors, the cost is reduced. The voltage drop across the emitter-collector of the transistor 3 is also reduced, with the resulting decrease in the power consumption and the heat generation. Still further, the current amplification factor of the transistor 3 can also be reduced to about 1 to 3.

While, in the above-described embodiment, the base current shunt means is comprised of a thyristor, it may be comprised of a transistor. Also, the signal generator 5 may for example be comprised of the signal generator incorporated in the magneto, the signal generator driven from a shaft different from that of the magneto or the signal generating circuit formed in the ignition circuit.

While, in the above-described embodiment, the positive-going half-waves from the generating coil 1 are utilized and the flow of the negative-going half waves is prevented providing an open condition, a circuit construction may also be used in which a diode is connected in inverse parallel relation with the generating coil 1 so as to short-circuit the negative-going half waves.

FIGS. 2 to 6 are circuit diagrams respectively showing second to sixth embodiments of the invention utilizing various forms of signal generators 5 and shunting means.

Figure 2:
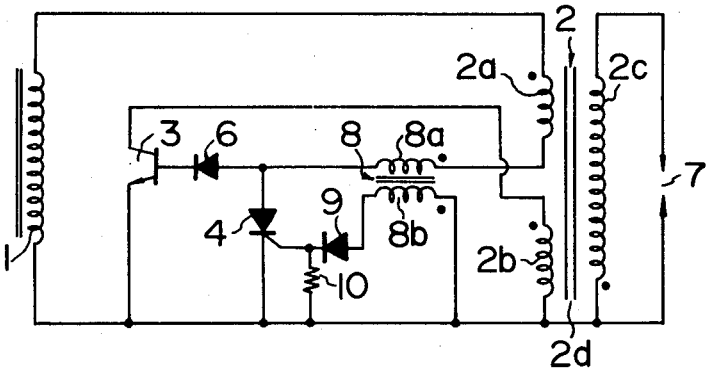

The second embodiment shown in FIG. 2 differs from the first embodiment in that the signal generating means comprises a transformer 8 including a primary coil 8*a* connected between the primary winding 2*a* of the ignition coil 2 and the base of the transistor 3 and a secondary coil 8*b* connected between the gate and cathode of the thyristor 4. The output generated in the secondary coil 8*b* of the transformer 8 is applied to the gate of the thyristor 4 through a diode 9. In the Figure, numeral 10 designates a resistor for adjusting the gate voltage of the thyristor 4.

The operation of the second embodiment of FIG. 2 will now be described. When the positive-going half wave from the generating coil 1 causes a current flow through the primary winding 2*a* of the ignition coil 2, the primary coil 8*a* of the transformer 8, the diode 6 and the base-emitter path of the transistor 3, a voltage is induced in the secondary coil 8*b* of the transformer 2. Since this induced voltage lags 90 degrees in phase from the current in the primary coil 8*a*, the diode 9 blocks the voltage generated in the secondary coil 8*b* of the transformer 8 when the primary current of the transformer 8 is tending to increase. When the voltage generated in the secondary coil 8*b* of the transformer 8 begins to decrease after the primary current of the transformer 8 and turned on the transistor 3, the decrease supplies a current to the gate of the thyristor 4 through the diode 9, the thyristor 4 is turned on so that the base current of the transistor 3 is shunted, and the transistor 3 is turned off, thus interrupting the short-circuit current flow in the auxiliary winding 2*b*.

While, with the polarity of the transformer 8 shown in FIG. 2, the thyristor 4 is turned off when the current in the primary coil 8*a* is tending to decrease, by changing the polarity of the secondary coil 8*b* of the transformer 8 it is possible to turn on the thyristor 4 when the primary current is tending to increase.

Figure 3:
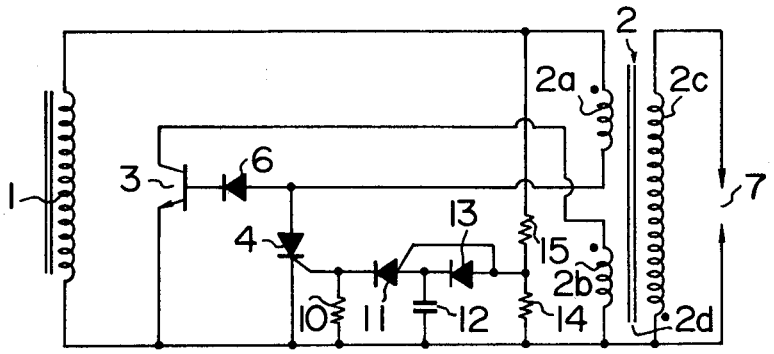

The third embodiment shown in FIG. 3 differs from the second embodiment in that the signal generating means comprises voltage dividing resistors 14 and 15 connected between the terminals of the generatng coil 1, a diode 13, a capacitor 12 disposed to be charged through the diode 13 by the potential at the voltage dividing point of the voltage dividing resistors 14 and 15, and a programmable unijunction transistor or PUT 11 having its gate connected to the voltage dividing point of the voltage dividing resistors 14 and 15 and its cathode connected to the thyristor 4. The output of the PUT 11 is thus applied to the gate of the thyristor 4.

The operation of the system shown in FIG. 3 will now be described. When the terminal voltage of the generating coil 1 is tending to increase, the capacitor 12 is charged through the diode 13 by the terminal voltage of the resistor 14.

Then, when the terminal voltage of the generating coil 1 starts to decrease, the terminal voltage of the resistor 14 decreases so that when the voltage on the capacitor 12 (or the anode voltage of the PUT 11) becomes higher than the terminal voltage of the resistor 14 (or the gate voltage of the PUT 11), the PUT 11 is turned on and the voltage is applied to the gate of the thyristor 4 from the capacitor 12, thus turning the thyristor 4 on. Thus, the base current of the transistor 3 is shunted and the transistor 3 is turned off, thus interrupting the short-circuit current flow in the auxiliary winding 2*b*.

Figure 4:
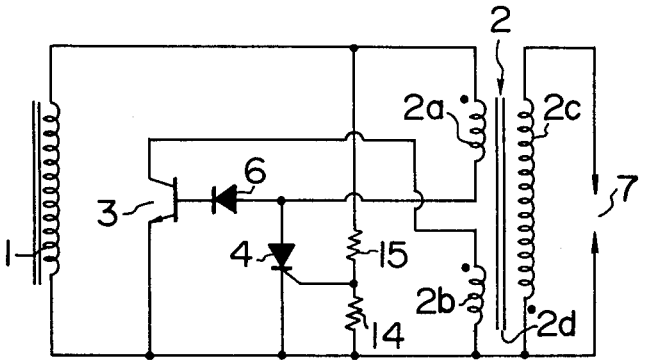

The fourth embodiment of FIG. 4 differs from the first embodiment in that the signal generating means comprises voltage dividing resistors 14 and 15 and the voltage dividing point of the voltage dividing resistors 14 and 15 is connected to the gate of the thyristor 4.

The operation of the fourth embodiment shown in FIG. 4 will now be described. When the terminal voltage of the generating coil 1 is tending to increase and when the terminal voltage of the resistor 14 exceeds the gate trigger level of the thyristor 4, the thyristor 4 shunts the base current of the transistor 3 so that the transistor 3 is turned off and the short-circuit current flow in the auxiliary winding 2*b* is interrupted.

Figure 5:
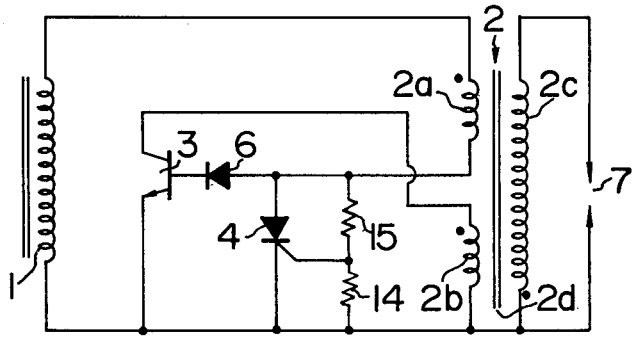

The fifth embodiment shown in FIG. 5 differs from the fourth embodiment in that the voltage dividing resistors 14 and 15 forming the signal generating means are connected between the anode of the diode 6 and the emitter of the transistor 3 and the voltage dividing point of the resistors 14 and 15 is connected to the gate of the thyristor 4.

Next, the operation of the fifth embodiment shown in FIG. 5 will be described. The voltage drop across the diode 6 and the base-emitter section of the transistor 3 is divided by the resistors 14 and 15 to generate a gate signal voltage for the thyristor 4. The remaining operation of this embodiment is the same with the fourth embodiment of FIG. 4. In the fourth embodiment of FIG. 4, when the transistor 3 is turned off, the voltage across the supply coil 1 rises, and the power which is effective for the secondary voltage will be consumed by the resistor 15. In the fifth embodiment of FIG. 5, the resistor 15 is short-circuited by the thyristor 4 and the primary current of the ignition coil 2 flows through the thyristor 4, thus preventing the consumption of power by the resistor 15.

Figure 6:
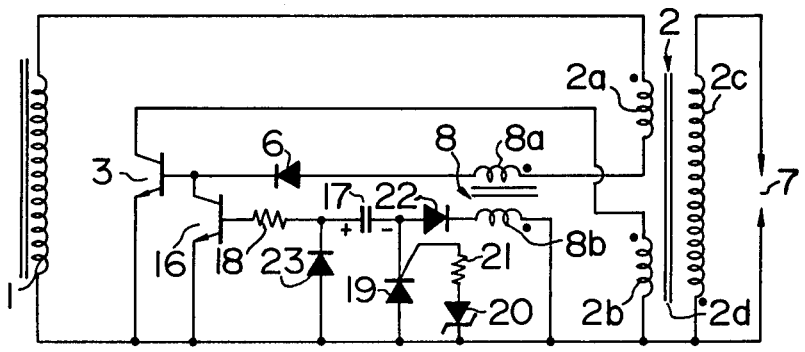

The sixth embodiment shown in FIG. 6 differs from the first embodiment in that the thyristor 4 is replaced with a transistor 16 and that the signal generating means comprises a transformer 8, diodes 22 and 23, a capacitor 17, resistors 18 and 21, a thyristor 19 and a Zener diode 20.

The operation of the sixth embodiment of FIG. 6 will now be described. When a positive voltage is generated in the generating coil 1, current flows through the primary winding 2*a* of the ignition coil 2, a primary coil 8*a* of the transformer 8, the diode 6 and the base-emitter path of the transistor 3.

When this current is tending to increase, the electromotive force generated in a secondary coil 8*b* of the transformer 8 charges the capacitor 17 in the polarity shown through the circuit including the secondary coil 8*b*, the diode 23, the capacitor 17, the diode 22 and the secondary coil 8*b*. When the terminal voltage of the secondary coil 8*b* rises and reaches a predetermined voltage, the Zener diode 20 is turned on and the thyristor 19 is turned on.

At this moment, the charge stored in the capacitor 17 is discharged through the resistor 18, the base-emitter path of the transistor 16 and the thyristor 19, and the transistor 16 is turned on. When this occurs, the base current of the transistor 3 is shunted so that the transistor 3 is turned off and the short-circuit current flow in the auxiliary winding 2*b* is interrupted rapidly, thereby generating a high voltage in the secondary winding 2*c*.

In this case, the "ON" period of the transistor 16 is determined by the discharge time of the capacitor 17 which is dependent on the values of the capacitor 17 and the resistor 18, and the transistor 3 remains off during the "ON" period.

If the positive-going voltage of the generating coil 1 still remains after the lapse of this "ON" period, the transistor 3 is turned on again. As a result, the time period during which a high voltage will be supplied to the spark plug from the secondary winding 2*c* of the ignition coil 2, can be adjusted in dependence on the previously mentioned discharge time of the capacitor 17 and hence the duration time of spark at the spark plug 17 can be prevented from becoming unnecessarily long.

We claim:

1. An ignition system for internal combustion engines comprising:

a generating coil incorporated in a magneto for generating a primary current;

an ignition coil including a primary winding connected to said generating coil to receive said primary current, an auxiliary winding electromagnetically coupled to said primary winding and responsive to a magnetic flux produced by said primary current in said primary winding to generate an electromotive force, such that an electromotive force produced in said primary winding and said electromotive force produced in said auxiliary winding are mutually cancelled, and a secondary winding electromagnetically coupled to said auxiliary winding and said primary winding to generate an ignition high voltage;

transistor means having base, collector and emitter electrodes, said base electrode being connected to said primary winding of said ignition coil to cause flow of said primary current through a base-emitter path of said transistor means, the ends of said auxiliary winding being connected between said collector and emitter electrodes, whereby when said transistor means is non-conductive current flowing in said auxiliary winding is interrupted and the cancelling of said electromotive force produced in said primary winding is released so as to generate a high voltage in said secondary winding;

a thyristor connected to said base electrode of said transistor means and said primary winding, whereby said primary current from said primary winding is shunted so as to make said transistor means nonconductive; and signal generating means connected to said semiconductor switching element so as to cause said shunting operation of said semiconductor switching element at a predetermined ignition time, said signal generating means including:

a transformer having a primary coil connected between said ignition coil primary winding and said transistor base electrode to pass said primary current therethrough, and a secondary coil electromagnetically coupled to said transformer primary coil and connected to a gate electrode of said thyristor so as to apply to said thyristor gate electrode an output voltage induced in response to the flow of said primary current through said transformer primary coil.

2. An ignition system for internal combustion engines comprising:

a generating coil incorporated in a magneto for generating a primary current;

an ignition coil including a primary winding connected to said generating coil to receive said primary current, an auxiliary winding electromagnetically coupled to said primary winding and responsive to a magnetic flux produced by said primary current in said primary winding to generate an electromotive force, such that an electromotive force produced in said primary winding and said electromotive force produced in said auxiliary winding are mutually cancelled, and a secondary winding electromagnetically coupled to said auxiliary winding and said primary winding to generate an ignition high voltage;

transistor means having base, collector and emitter electrodes, said base electrode being connected to said primary winding of said ignition coil to cause flow of said primary current through a base-emitter path of said transistor means, the end of said auxiliary winding being connected between said collector and emitter electrodes, whereby when said transistor means is non-conductive current flowing in said auxiliary winding is interrupted and the cancelling said electromotive force produced in said primary winding is released so as to generate a high voltage in said secondary winding, a thyristor connected to said base electrode of said transistor means and said primary winding, whereby said primary current from said primary winding is shunted so as to make said transistor means nonconductive; and signal generating means connected to said semiconductor switching element so as to cause said shunting operation of said semiconductor switching element at a predetermined ignition time, said signal generating means including:

a pair of voltage dividing resistors connected across said generating coil;

a capacitor disposed so as to be charged from said voltage dividing resistors through a diode; and a programmable unijunction transistor having an anode electrode connected to said capacitor, a cathode electrode connected to a gate electrode of said thyristor and a gate electrode connected to a voltage dividing point of said voltage dividing resistors, whereby when a voltage across said capacitor exceeds a voltage at said voltage dividing point of said voltage dividing resistors, said capacitor voltage is applied to the gate electrode of said thyristor.

3. An ignition system for internal combustion engines comprising:

a generating coil incorporated in a magneto for generating a primary current;

an ignition coil including a primary winding connected to said generating coil to receive said primary current, an auxiliary winding electromagnetically coupled to said primary winding and responsive to a magnetic flux produced by said primary current in said primary winding to generate an electromotive force, such that an electromotive force produced in said primary winding and said electromotive force produced in said auxiliary winding are mutually cancelled, and a secondary winding electromagnetically coupled to said auxiliary winding and said primary winding to generate an ignition high voltage;

transistor means having base, collector and emitter electrodes, said base electrode being connected to said primary winding of said ignition coil to cause flow of said primary current through a base emitter path of said transistor means, the ends of said auxiliary winding being connected between said collector and emitter electrodes, whereby when said transistor means is non-conductive current flowing in said auxiliary winding is interrupted and the cancelling of said electromotive force produced in said primary winding is released so as to generate a high voltage in said secondary winding;

a thyristor connected to said base electrode of said transistor means and said primary winding, whereby said primary current from said primary winding is shunted so as to make said transistor means non-conductive; and signal generating means connected to said semiconductor switching element so as to cause said shunting operation of said semiconductor switching element at a predetermined ignition time, said signal generating means including a pair of voltage dividing resistors connected across said generating coil and having a voltage dividing point connected to a gate electrode of said thyristor.

4. An ignition system for internal combustion engines comprising:

a generating coil incorporated in a magneto for generating a primary current;

an ignition coil including a primary winding connected to said generating coil to receiving said primary current, an auxiliary winding electromagnetically coupled to said primary winding and responsive to a magnetic flux produced by said primary current in said primary winding to generate an electromotive force, such that an electromotive force produced in said primary winding and said electromotive force produced in said auxiliary winding are mutually cancelled, and a secondary winding electromagnetically coupled to said auxiliary winding and said primary winding to generate an ignition high voltage;

transistor means having base, collector and emitter electrodes, said base electrode being connected to said primary winding of said ignition coil to cause flow of said primary current through a base-emitter path of said transistor means, the end of said auxiliary winding being connected between said collector and emitter electrodes, whereby when said transistor means is non-conductive current flowing in said auxiliary winding is interrupted and the cancelling of said electromotive force produced in said primary winding is released so as to generate a high voltage in said secondary winding;

a thyristor connected to said base electrode of said transistor means and said primary winding, whereby said primary current from said primary winding is shunted so as to make said transistor means nonconductive; and signal generating means connected to said semiconductor switching element so as to cause said shunting operation of said semiconductor switching element at a predetermined ignition time, said signal generating means including a pair of voltage dividing resistors connected to said primary winding of said ignition coil and having a voltage dividing point connected to a gate electrode of said thyristor.

5. An ignition system for internal combustion engines comprising:

a generating coil incorporated in a magneto for generating a primary current;

an ignition coil including a primary winding connected to said generating coil to receive said primary current, an auxiliary winding electromagnetically coupled to said primary winding and responsive to a magnetic flux produced by said primary current in said primary winding to generate an electromotive force, such that an electromotive force produced in said primary winding and said electromotive force produced in said auxiliary winding are mutually cancelled, and a second winding electromagnetically coupled to said auxiliary winding and said primary winding to generate an ignition high voltage;

transistor means having base, collector and emitter electrodes, said base electrode being connected to said primary winding of said ignition coil to cause flow of said primary current through a base-emitter path of said transistor means, the end of said auxiliary winding being connected between said collector and emitter electrodes, whereby when said transistor means is non-conductive current flowing in said auxiliary winding is interrupted and the cancelling of said electromotive force produced in said primary winding is released so as to generate a high voltage in said secondary winding;

a transistor connected to said base electrode of said transistor means and said primary winding, whereby said primary current from said primary winding is shunted so as to make said transistor means non-conductive; and signal generating means connected to said semiconductor switching element so as to cause said shunting operation of said semiconductor switching element at a predetermined ignition time, said signal generating means including:

a transformer having a primary coil connected between said ignition coil primary winding and the base electrode of said transistor means to pass said primary current therethrough, and a secondary coil electromagnetically coupled to said transformer primary coil;

a capacitor connected to said transformer secondary coil so as to be charged through a diode; and a thyristor connected to said capacitor and to said transistor forming said semiconductor switching element, whereby when a voltage across said capacitor exceeds a predetermined value, said thyristor is turned on such that said capacitor is discharged and said semiconductor switching element transistor is turned on.

* * * * *